United States Patent [19]
Hupp
[11] 4,440,065
[45] Apr. 3, 1984

[54] BREECH MECHANISM FOR AUTOMATIC FIREARMS

[75] Inventor: Gerhard Hupp, Oberndorf, Fed. Rep. of Germany

[73] Assignee: Mauser-Werke Oberndorf GmbH, Oberndorf, Fed. Rep. of Germany

[21] Appl. No.: 330,829

[22] Filed: Dec. 15, 1981

[51] Int. Cl.³ ..... F41D 5/04
[52] U.S. Cl. ..... 89/191 R
[58] Field of Search ..... 89/191 R, 191 A, 193, 89/198

[56] References Cited

U.S. PATENT DOCUMENTS

| | | | |
|---|---|---|---|
| 1,233,096 | 7/1917 | Martinez-Silva | 89/192 X |
| 1,788,279 | 1/1931 | Cutts | 89/198 X |
| 3,318,192 | 5/1967 | Miller | 89/199 X |
| 3,517,586 | 6/1970 | Stoner | 89/198 |
| 4,244,273 | 1/1981 | Langendorfer | 89/193 |

FOREIGN PATENT DOCUMENTS

| | | | |
|---|---|---|---|
| 1678508 | 3/1970 | Fed. Rep. of Germany | 89/191 R |

*Primary Examiner*—Donald G. Kelly
*Attorney, Agent, or Firm*—Scully, Scott, Murphy & Presser

[57] ABSTRACT

A breech mechanism for automatic firearms having a high cadence; and, in particular, a rigidly closing breech mechanism which includes a gas piston effecting the opening thereof and which stands in communication with a sleeve, a coil spring concentrically positioned interiorly thereof which is stressed upon the opening of the breech mechanism and which will conduct a latching and unlatching component into its closing position upon release of the energy stored therein. The gas piston as well as the closure spring each have a shock absorber associated therewith. The shock absorbers essentially consist of loose, stacked discs, plates or the like of high rigidity and toughness, whose surfaces incorporate production-caused uneveness.

4 Claims, 2 Drawing Figures

BREECH MECHANISM FOR AUTOMATIC FIREARMS

BACKGROUND OF THE INVENTION

1. Field of the Invention

The present invention relates to a breech mechanism for automatic firearms having a high cadence; and, in particular, a rigidly closing breech mechanism which includes a gas piston effecting the opening thereof and which stands in communication with a sleeve, a coil spring concentrically positioned interiorly thereof which is stressed upon the opening of the breech mechanism and which will conduct a latching and unlatching component into its closing position upon release of the energy stored therein.

2. Discussion of the Prior Art

Modern automatic firearms of calibers in the magnitude of about 20 to 40 millimeters will, as a rule, evidence high cadences. These high cadences are required in order, within the shortest time to be able to direct a large number of projectiles into a target, such as flying objects moving within the sonic or supersonic range.

In automatic firearms, due to constantly higher set output requirements, there occur higher accelerations and load peaks in all dynamically moving components. This will result, particularly in the breech mechanism and the components operating in conjunction therewith, in an always increasing mechanical wear at a concurrent intensively reducing life expectancy. As a direct result of these phenomena, there will appear defects which render questionable the fitness for use of the weapon. This fitness for use must be afforded in the case of combat under all possible contemplatable conditions in order to respond to the current tactical combat requirements and, moreover, that the operating personnel need not be unnecessarily exposed beyond present conditions to the effect of the weapons of the opponent or enemy.

SUMMARY OF THE INVENTION

Proceeding from the currently recognized state of the technology with its short-comings both as to design concepts and limitations in performance of breech mechanism constructions, it is a specific object of the present invention to eliminate or at least to so reduce shock-like loads (shock waves) with negative effects particularly on the breech mechanism components, through the use of relatively simple technical means so as to attain a significant increase in the life expectancy of these components.

The foregoing object is inventively achieved in that, respectively, the gas piston as well as the closure spring each have a shock absorber associated therewith.

In another and generally applicable configuration of the concept underlying the present invention, the shock absorbers essentially consist of loose, stacked discs, plates or the like of high rigidity and toughness, whose surfaces incorporate production caused uneveness. The discs, plates or the like, pursuant to another inventive feature, consist of known spring-steel bands. Other features of the invention can be ascertained from the description hereinbelow.

Through the present invention there is attained a series of advantages which, most importantly, consist of in that during firing unavoidably encountered high accelerations and load peaks are reduced by means of the inventive shock absorbers to a measure which will impart lower loading on the breech mechanism components or modules. Particularly suitable for that type of shock absorber has been found to be an aggregate of a large number of spring-steel sheets assembled into a packet whose surfaces evidence uneveness or roughness produced during manufacture. In a multiple-layer arrangement of that type, there is already formed with about five layers, a spring movement in a magnitude of about 0.3 mm. Due to this condition, there is obtained a relatively steep spring characteristic which effects a large load take-up and thereby, concurrently a significant reduction in a previously introduced load peak. That type of behavior is not inherent to the known plate springs. These have, accordingly, been found as unsuitable for the reduction of the mentioned load peaks, since no damping effect is present.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figures 1, 2:
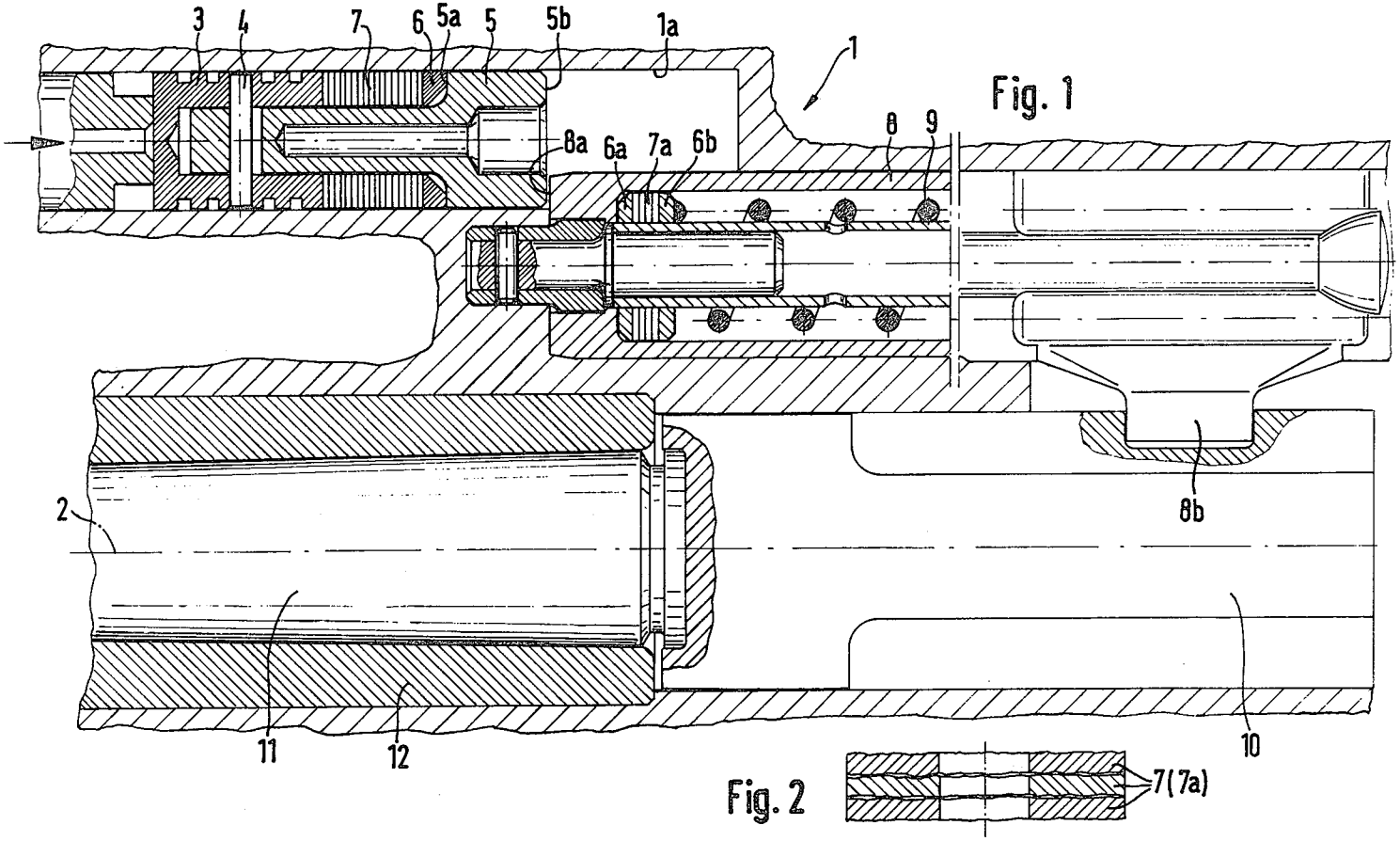
FIG. 1 illustrates a vertical section through the breech mechanism of an automatic firearm.
FIG. 2 illustrates the superposition of three spring-steel sheets whose surfaces evidence uneveness produced during manufacture.

In the housing 1*a* of the breech mechanism which is generally identified by reference numeral 1, of an automatic firearm, not further shown in detail, arranged axially parallel to bore axis 2 is a slidably displaceable piston 3. Fixedly connected with the piston 3 is a spacer member 5 through the intermediary of a pin 4. Arranged on the spacer member 5 between the piston 3 under the insertion of a closure disc 6 contacting against the shoulder 5*a*, is a shock absorber 7 formed of a large number of loose stacked discs, plates or the like.

When being acted upon by gas (arrow), the piston together with the spacer member 5, closure disc 6 and shock absorber 7, is conducted impact-like from its one end position (forward—towards the left) into its other end position (rearward—towards the right). The annular shaped edge 5*b* of the spacer member 5 hereby impacts against the generally conforming edge 8*a* of the closure spring housing 8. Hereby, this is also conducted impact-like from its closed position (forward—towards the left) into its open position (rearward—towards the right). During this movement cycle there is concurrently stressed a closure spring 9 which is supported against a further shock absorber 7*a* and arranged concentrically within the housing 8. Furthermore, a protuberance 8*b* on the housing 8 similarly effects the impact-like conductance of the therewith coupled latching and unlatching component 10 towards the right, in essence, into its opened position, so that by means of an ejector (not shown) the empty cartridge shell 11 can be pulled out of the cartridge support 12 and then ejected.

The above-described operating sequence within the weapon during firing has been known for a long period of time. However, it has been so extensively described herein in order to clearly demonstrate which high accelerations and load peaks will constantly act on the breech mechanism and its individual components; these loads on the breech mechanism increase permanently during more or less lengthy firing bursts. The inventively provided shock absorbers 7, *7a* (and occasionally other shock absorbers which are arrangeable at other suitable locations) reduce the high accelerations and load peaks to a corresponding measure supportable by the applicable components. The life expectancy of these components, the weapon itself and thereby concurrently its capacity for use is significantly increased by means of the shock absorbers 7, *7a*.

Ascertainable in FIG. 2 of the drawings, is a large number of loose, stacked discs, plates or the like (7, *7a*) forming an inventive shock absorber in their entirety, with their surfaces provided with uneveness imparted during their manufacture. The discs or plates may be assembled into a modular packet and covered with an elastic covering, such as a plastic material.

What is claimed is:

1. In a breech mechanism for automatic firearms having a high cadence, particularly a rigidly closing breech mechanism, including a gas piston effecting the opening of said mechanism; a sleeve in communication with said gas piston; a coil spring concentrically arranged in said sleeve and being stressed upon opening of said breech mechanism, and a latching and unlatching component being conducted into closing position upon release of the energy stored in said spring; the improvement comprising shock absorber means being associated with, respectively, said gas piston and with said closure coil spring, each of said shock absorber means essentially comprising a plurality of loose, stacked discs or plates of high ductility and toughness, the surfaces of said discs or plates having unevenesses formed therein which are permitted to remain unsmoothed and unfinished during the formation thereof.

2. Breech mechanism as claimed in claim 1, said discs or plates being formed of spring-steel bands.

3. Breech mechanism as claimed in claim 1, said loose, stacked discs of said shock absorber means being assembled into a modular packet; and closure discs limiting said discs in the axial direction, said closure discs providing a strength which is a multiple of that of an individual disc.

4. Breech mechanism as claimed in claim 3, said modular packet including an elastic covering formed of plastic material.

* * * * *